US010109942B2

(12) United States Patent
Sugaya et al.

(10) Patent No.: US 10,109,942 B2
(45) Date of Patent: Oct. 23, 2018

(54) ELECTRIC CONNECTOR HAVING A RECEPTACLE WITH AN ENLARGED PORTION TO LOCK AN ENLARGED PORTION OF CONTACTS

(71) Applicant: FUJIKURA LTD., Kohtoh-ku, Tokyo (JP)

(72) Inventors: Souichi Sugaya, Tokyo (JP); Toshihiko Hirai, Tokyo (JP); Kazunori Takei, Tokyo (JP); Kiyotaka Yamada, Tokyo (JP)

(73) Assignee: FUJIKURA LTD., Kohtoh-Ku, Tokyo (JP)

( * ) Notice: Subject to any disclaimer, the term of this patent is extended or adjusted under 35 U.S.C. 154(b) by 0 days.

(21) Appl. No.: 15/856,354

(22) Filed: Dec. 28, 2017

(65) Prior Publication Data

US 2018/0183168 A1 Jun. 28, 2018

(51) Int. Cl.

| | |
|---|---|
| ***H01R 12/00*** | (2006.01) |
| ***H01R 13/24*** | (2006.01) |
| ***H01R 12/71*** | (2011.01) |
| ***H01R 13/405*** | (2006.01) |

(52) U.S. Cl.

CPC ..... *H01R 13/2464* (2013.01); *H01R 9/096* (2013.01); *H01R 12/716* (2013.01); *H01R 13/2407* (2013.01); *H01R 13/405* (2013.01)

(58) Field of Classification Search

CPC ..... H01R 9/096; H01R 12/52; H01R 12/62; H01R 12/716; H01R 13/6271; H01R 13/6272; H01R 23/02

USPC ..... 439/65, 69, 74, 357, 660

See application file for complete search history.

(56) References Cited

U.S. PATENT DOCUMENTS

| | | | | |
|---|---|---|---|---|
| 8,485,832 | B2 * | 7/2013 | Mashiyama | H01R 12/73 439/74 |
| 9,484,648 | B2 * | 11/2016 | Takenaga | H01R 12/716 |
| 2009/0176386 | A1 * | 7/2009 | Wu | H01R 12/716 439/74 |
| 2010/0190383 | A1 * | 7/2010 | Yamada | H01R 13/6315 439/680 |
| 2010/0221928 | A1 * | 9/2010 | Sato | H01R 13/20 439/74 |
| 2010/0291776 | A1 * | 11/2010 | Huang | H01R 13/2457 439/74 |
| 2012/0289096 | A1 * | 11/2012 | Mashiyama | H01R 12/716 439/692 |

(Continued)

FOREIGN PATENT DOCUMENTS

JP 2012238519 A 12/2012

*Primary Examiner* — Chandrika Prasad

(74) *Attorney, Agent, or Firm* — Procopio, Cory, Hargreaves & Savitch LLP

(57) ABSTRACT

In an electric connector, a receptacle contact has an elastic portion of at least one curved form between a contact portion and a connection portion. An inclination portion is formed between the elastic portion and the contact portion, and further an enlarged engaging portion communicating with the inclination portion is formed at the side of the contact portion. A housing is provided with the insertion hole for inserting the receptacle contact, and an enlarged locking portion is formed in a position corresponding to the enlarged engaging portion. The enlarged engaging portion is locked by the enlarged locking portion in detachment operation.

4 Claims, 9 Drawing Sheets

(56) References Cited

U.S. PATENT DOCUMENTS

| | | | | |
|---|---|---|---|---|
| 2013/0012039 | A1* | 1/2013 | Nose | H01R 12/716<br>439/74 |
| 2013/0012074 | A1* | 1/2013 | Mashiyama | H01R 12/73<br>439/660 |

* cited by examiner

ELECTRIC CONNECTOR HAVING A RECEPTACLE WITH AN ENLARGED PORTION TO LOCK AN ENLARGED PORTION OF CONTACTS

TECHNICAL FIELD

This invention relates to an electric connector used in communication equipment, electric instruments and electronics such as mobile terminals and audio instruments, and more particularly to a structure of the connector which maintains a connection stability while attaining a small-sizing (particularly in a widthwise direction) and a low profile and can prevent uplifting in the detachment or buckling in the insertion and provide a stable fitting.

BACKGROUND ART

In general, an electric connector connecting a substrate to a substrate, also called a board to board connector, comprises a plug connector and a receptacle connector in which the respective connector is mounted on the respective substrate and these connectors are fitted to each other to connect the substrates. The plug connector has at least a plug contact and a block, and the receptacle connector has at least a receptacle contact and a housing. In each of the connectors may be provided a fixture, if necessary.

An electric connector for connecting substrates to each other has been previously proposed by the applicant and disclosed in Patent Document 1 (JP-A-2012-238519).

SUMMARY OF INVENTION

Technical Problem

Recently, small-sizing of a connector has been promoted with small-sizing of communication equipment, electric instruments and electronics, and it has been required to maintain a connection stability and provide a stable fitting while attaining a small-sizing (particularly in a widthwise direction) and a low profile. When the size of the connector disclosed in Patent Document 1 is made further small (particularly in a widthwise direction), however, the receptacle contact is uplifted in the detachment of the plug connector, leading to buckling in the insertion of the plug connector, and hence there is a problem that both contacts are broken and stable connection cannot be obtained.

The invention is made in consideration of the problem inherent to the conventional technique and is to provide an electric connector of a structure which maintains a connection stability while attaining a small-sizing (particularly in a widthwise direction) and a low profile and can prevent uplifting in the detachment or buckling in the insertion and provide a stable fitting.

Solution to Problem

In order to achieve the above object, the invention provides an electric connector of the following constructions:

(1) An electric connector comprising a plug connector and a receptacle connector detachably fitting to each other, said plug connector comprising a plug contact having a contact portion contacting with a receptacle contact and a connection portion mounted onto a substrate and a block arranging and holding the plug contact and having a first fitting port for inserting a fitting portion of the receptacle connector, and said receptacle connector comprising a receptacle contact having a contact portion contacting with the plug contact and a connection portion mounted onto a substrate and a housing arranging and holding the receptacle contact and having a fitting portion entering the first fitting port of the plug connector and a second fitting port for inserting the plug connector, wherein the plug contact is held with the block by integral molding and is provided with a concave portion for inserting the receptacle contact;

the receptacle contact is provided between the contact portion and the connection portion with an elastic portion of at least one curved form in the order of the contact portion, elastic portion and connection portion, and a fixing portion for holding in the housing is provided in a part of the elastic portion at the side of the connection portion, and an inclination portion is formed between the elastic portion and the contact portion, and further an enlarged engaging portion communicating with the inclination portion is formed at the side of the contact portion;

the housing is provided with an insertion hole for inserting the receptacle contact, and the insertion hole is formed continuously to the curved inclination portion, and an enlarged locking portion is formed in a position corresponding to the enlarged engaging portion;

the plug contact is interleaved between the contact portion and the elastic portion of the receptacle contact to provide a stable connection and the enlarged engaging portion is locked by the enlarged locking portion in detachment to prevent uplifting and suppress buckling in re-insertion.

(2) An electric connector of the item (1), wherein a first chamfering portion is formed in the contact portion of the receptacle contact and a second chamfering portion is formed in a part of the elastic portion at the side of the fixing portion, and the first chamfering portion of the receptacle contact is engaged with the concave portion of the plug contact to provide click feeling and positioning and contacting.

(3) An electric connector of the item (1), wherein a first fixture and a second fixture contacting with each other in the fitting of the connectors are provided at either end of the connector in a longitudinal direction or an arranging direction of the contacts.

(4) An electric connector of the item (3), wherein the first fixture comprises a main body, a contact wall communicating from the main body and contacting with the second fixture, fixing pieces communicating in a widthwise direction or a facing direction of the contacts and a connection portion communicating with the contact wall, and the second fixture comprises a front wall located at the side of the second fitting port, a contact portion formed by disposing a space in the front wall and arranged so as to protrude in the second fitting port, two side walls communicating with the front wall in the widthwise direction, and a back wall arranged opposite to the front wall.

Advantageous Effects of Invention

According to the electric connector of the invention, the enlarged engaging portion of the receptacle contact is engaged with the enlarged locking portion of the housing in the detachment while attaining a small-sizing (particularly in a widthwise direction) and a low profile, whereby uplifting of the receptacle contact can be prevented in the detachment of the connectors, whereas stable connection can be obtained in the re-insertion without buckling and causing breakage of both contacts because the receptacle contact is not uplifted in the insertion.

EMBODIMENTS FOR CARRYING OUT THE INVENTION

Figure 1A:
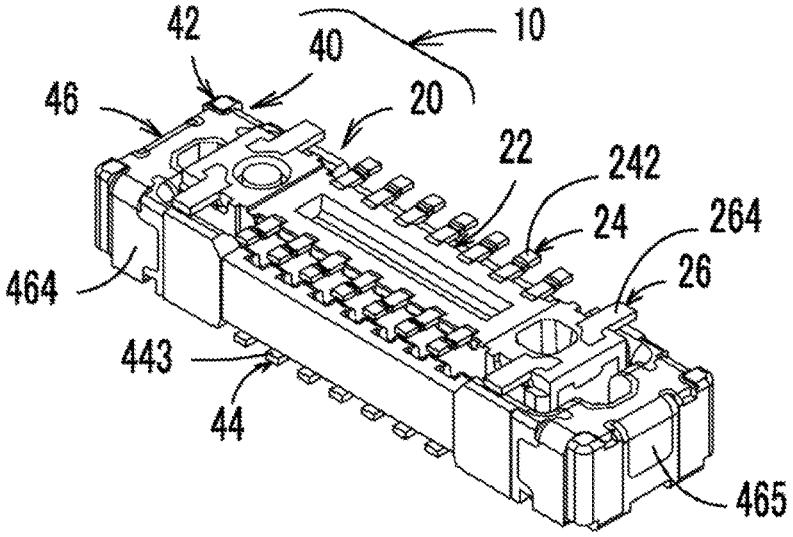
FIG. 1(A) is a perspective view of a connector illustrating a state of fitting a plug connector to a receptacle connector viewing from a direction of the plug connector.

The invention is an electric connector 10 detachably fitting a plug connector 20 to a receptacle connector 40. The plug connector 20 comprises a plug contact 24 having a contact portion 241 contacting with a receptacle contact 44 and a connection portion 242 mounted onto a substrate and a block 22 arranging and holding the plug contact 24 and having a first fitting port 12 for inserting a fitting portion 14 of the receptacle connector 40. The receptacle connector 40 comprises a receptacle contact 44 having a contact portion 441 contacting with the plug contact 24 and a connection portion 443 mounted onto a substrate and a housing 42 arranging and holding the receptacle contact 44 and having a fitting portion 14 entering the first fitting port 12 of the plug connector 20 and a second fitting port 16 for inserting the plug connector 20. In this electric connector 10, the plug contact 24 is held with the block 22 by integral molding and is provided with a concave portion 243 for inserting the receptacle contact 44. The receptacle contact 44 is provided between the contact portion 441 and the connection portion 443 with an elastic portion 444 of at least one curved form in the order of the contact portion 441, elastic portion 444 and connection portion 443, and a fixing portion 442 for holding in the housing 42 is provided in a part of the elastic portion 444 at the side of the connection portion 443, and an inclination portion 445 is formed between the elastic portion 444 and the contact portion 441 and further an enlarged engaging portion 45 communicating with the inclination portion 445 is formed at the side of the contact portion 441. The housing 42 is provided with an insertion hole 421 for inserting the receptacle contact 44, and the insertion hole 421 is formed continuously to a curved inclination portion 422, and an enlarged locking portion 43 is formed in a position corresponding to the enlarged engaging portion 45. The plug contact 24 is interleaved between the contact portion 441 and the elastic portion 444 of the receptacle contact 44 to provide a stable connection, and the enlarged engaging portion 45 is locked by the enlarged locking portion 43 in detachment to prevent uplifting and suppress buckling in re-insertion.

That is, the receptacle contact 44 is provided between the contact portion 441 and the connection portion 443 with the elastic portion 444 of at least one curved form, and the inclination portion 445 is formed between the elastic portion 444 and the contact portion 441, and the enlarged engaging portion 45 communicating with the inclination portion 445 is further formed at the side of the contact portion 441, while the housing 42 is provided with the insertion hole 421 for inserting the receptacle contact 44 and the enlarged locking portion 43 is formed at a position corresponding to the enlarged engaging portion 45, whereby the enlarged engaging portion 45 is locked by the enlarged locking portion 43 in the detachment of the plug contact 24 to prevent uplifting and suppress buckling in the re-insertion.

Figure 1B:
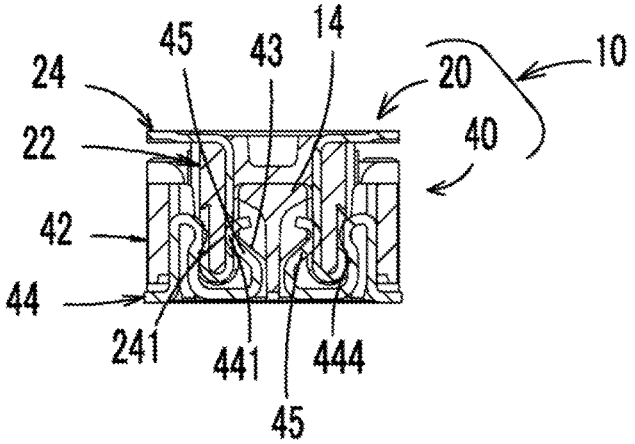
FIG. 1(B) is a section view of a connector in the state of FIG. 1(A) taken at a certain contact portion.
Figure 1C:
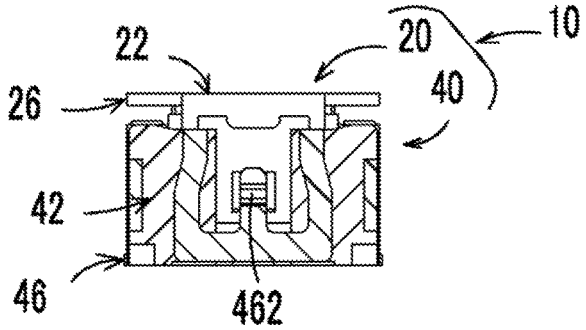
FIG. 1(C) is a section view of a connector in the state of FIG. 1(A) at a fixture.
Figure 2A:
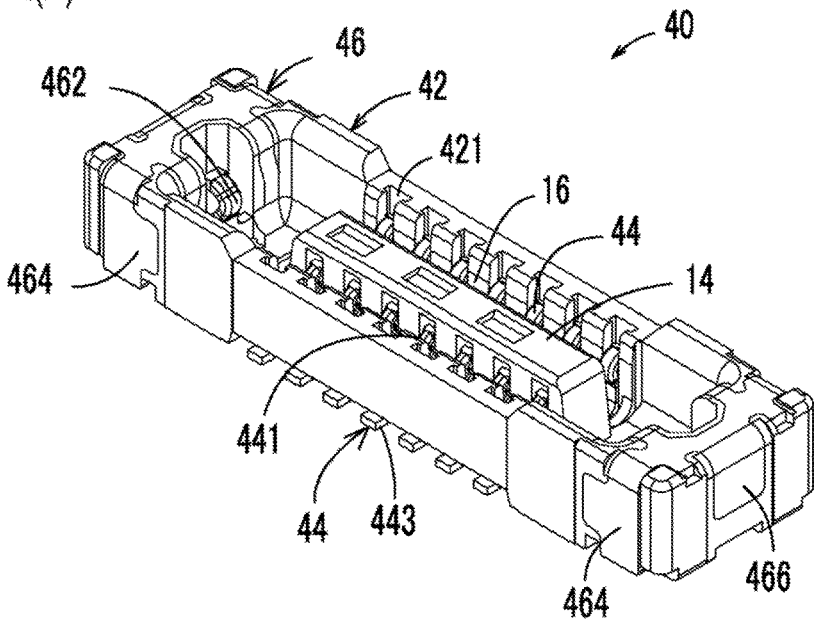
FIG. 2(A) is a perspective view of a receptacle connector viewing from a fitting direction.
Figure 2B:
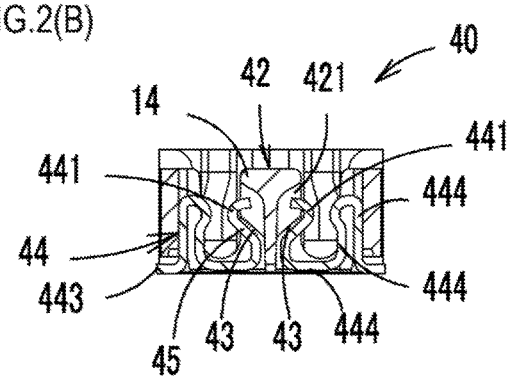
FIG. 2(B) is a longitudinal section view of the receptacle connector at a certain contact portion.
Figure 2C:
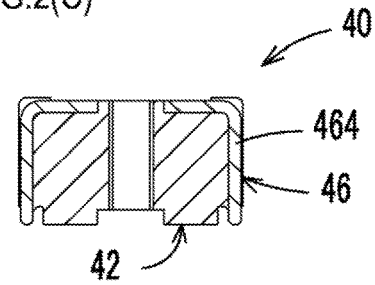
FIG. 2(C) is a section view of the receptacle connector at a second fixture.
Figure 2D:
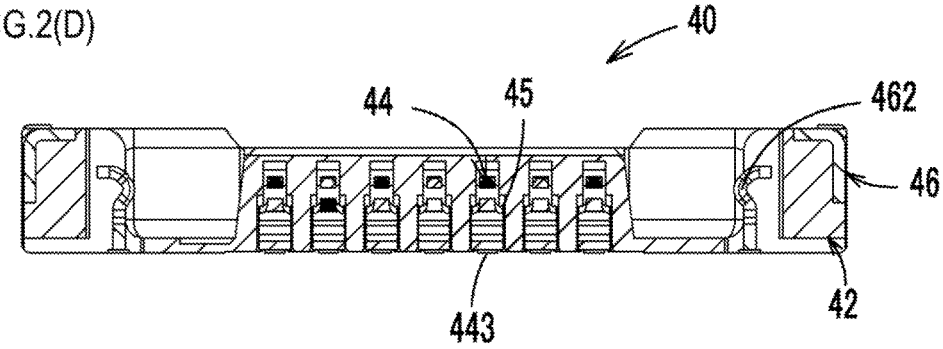
FIG. 2(D) is a horizontal section view of the receptacle connector at a contact portion.

FIG. 1(A) is a perspective view illustrating a state of fitting a plug connector to a receptacle connector viewing from a direction of the plug connector, and FIG. 1(B) is a section view of a connector in the state of FIG. 1(A) taken at a certain contact portion, and FIG. 1(C) is a section view of a connector in the state of FIG. 1(A) at a fixture. FIG. 2(A) is a perspective view of a receptacle connector viewing from a fitting direction, and FIG. 2(B) is a longitudinal section view of the receptacle connector at a certain contact portion, and FIG. 2(C) is a section view of the receptacle connector at a second fixture, and FIG. 2(D) is a horizontal section view of the receptacle connector at a contact portion.

Figure 3A:
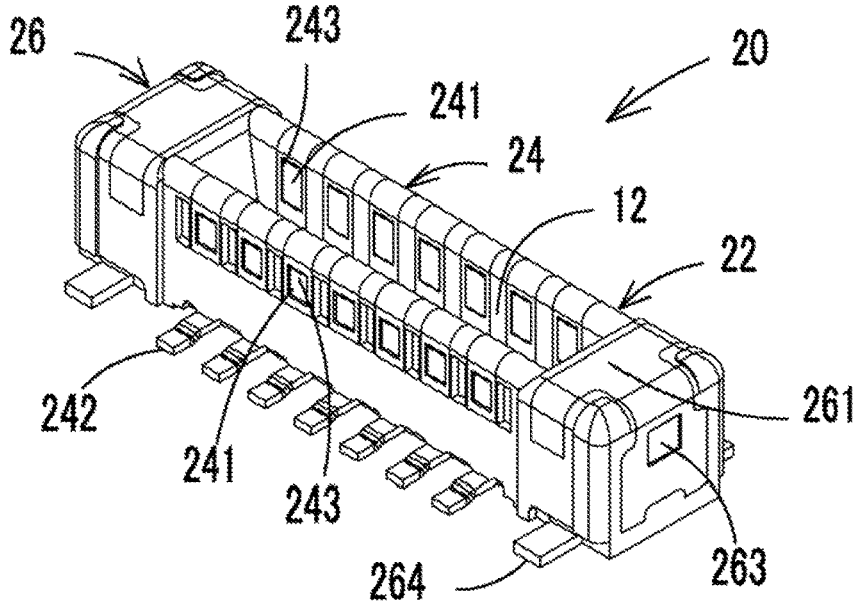
FIG. 3(A) is a perspective view of a plug connector viewing from a fitting direction.
Figure 3B:
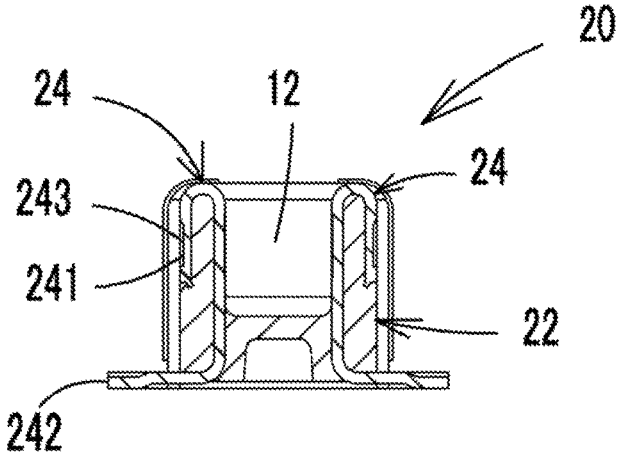
FIG. 3(B) is a longitudinal section view of the plug connector at a certain contact portion.
Figure 3C:
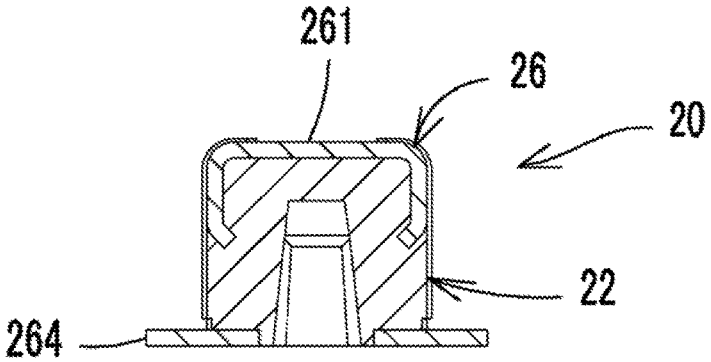
FIG. 3(C) is a section view of the plug connector at a first fixture.

FIG. 3(A) is a perspective view of a plug connector viewing from a fitting direction, and FIG. 3(B) is a longitudinal section view of the plug connector at a certain contact portion, and FIG. 3(C) is a section view of the plug connector at a first fixture.

Figure 4A:
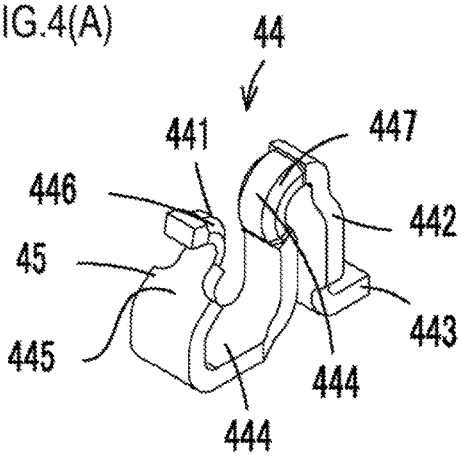
FIG. 4(A) is a perspective view of a receptacle contact viewing from a side of a contact portion.
Figure 4B:
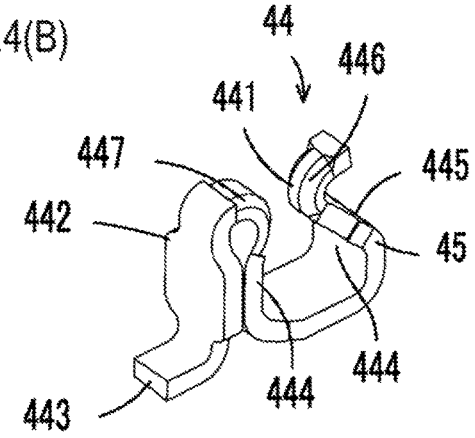
FIG. 4(B) is a perspective view of the receptacle contact viewing from an opposite side of the contact portion.
Figure 4C:
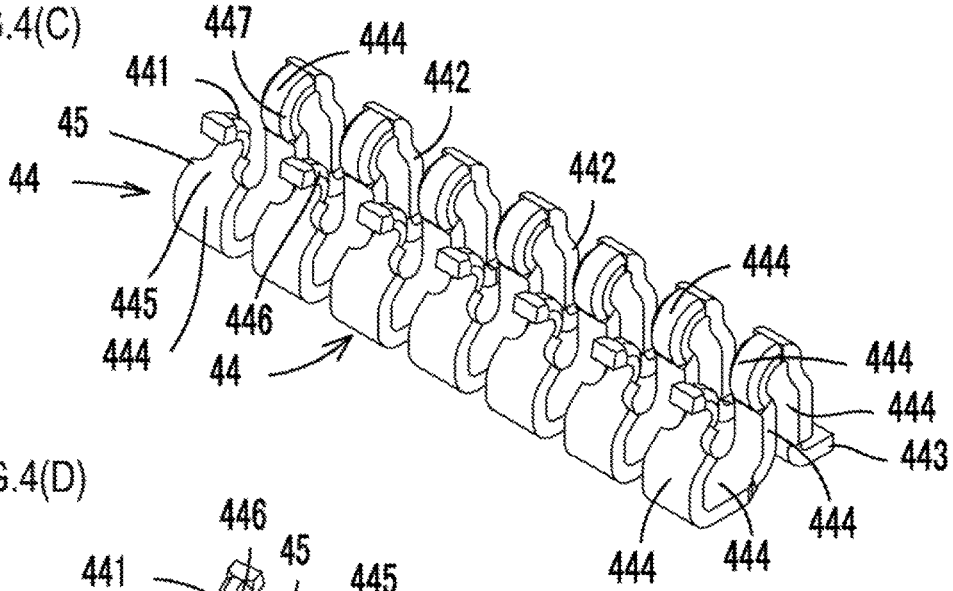
FIG. 4(C) is a perspective view of plural receptacle contacts viewing from a side of a contact portion.
Figure 4D:
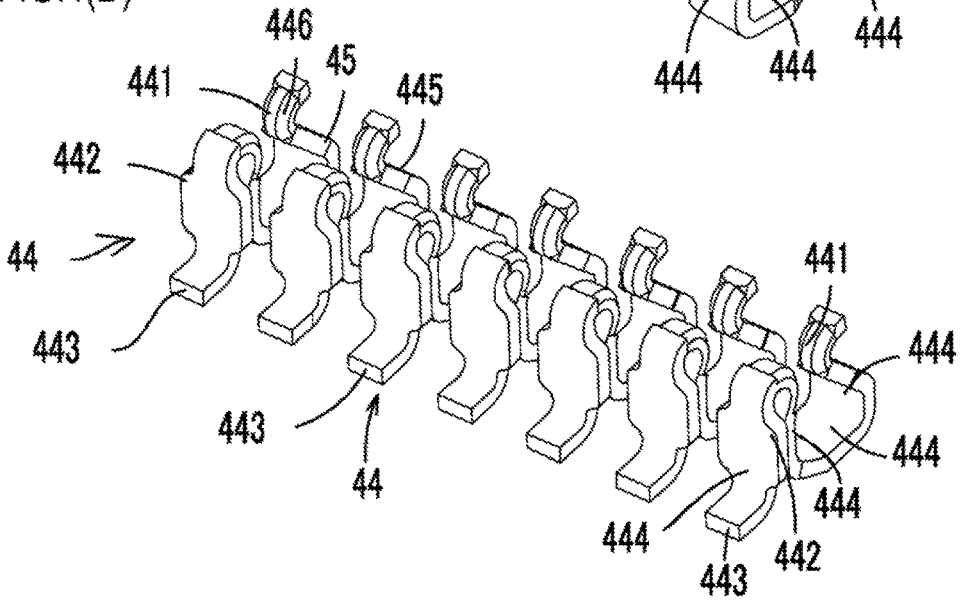
FIG. 4(D) is a perspective view of the plural receptacle contacts viewing from an opposite side of the contact portion.

FIG. 4(A) is a perspective view of a receptacle contact viewing from a side of a contact portion, and FIG. 4(B) is a perspective view of the receptacle contact viewing from an opposite side of the contact portion, and FIG. 4(C) is a perspective view of plural receptacle contacts viewing from a side of a contact portion, and FIG. 4(D) is a perspective view of the plural receptacle contacts viewing from an opposite side of the contact portion.

Figure 5A:
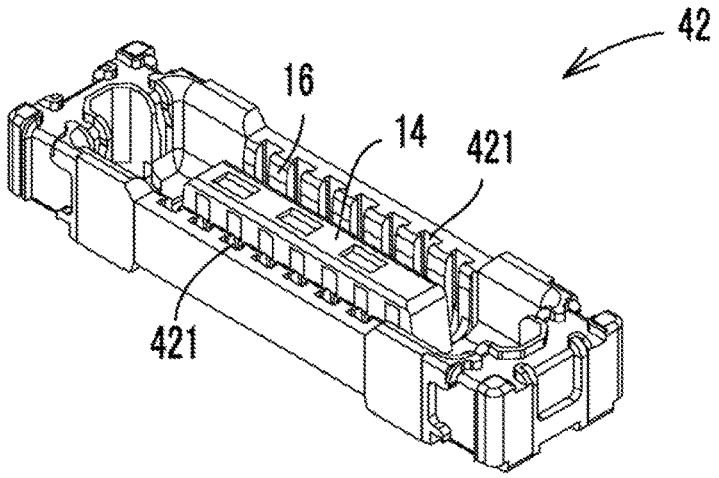
FIG. 5(A) is a perspective view of a housing viewing from a fitting direction.
Figure 5B:
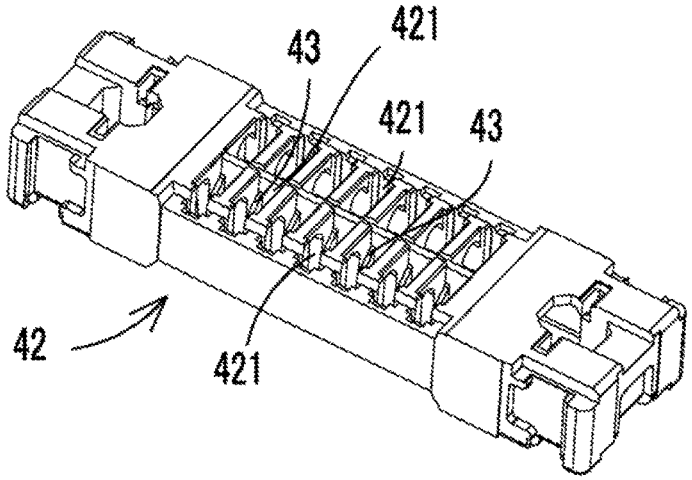
FIG. 5(B) is a perspective view of the housing viewing from an opposite side of the fitting direction.
Figure 5C:
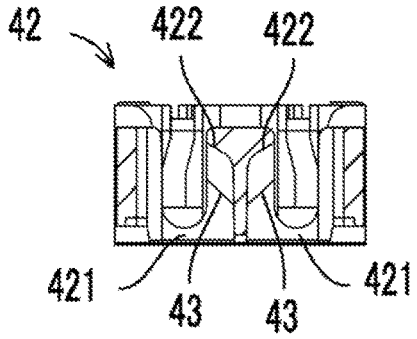
FIG. 5(C) is a section view of the housing at a portion fitting a receptacle contact.
Figure 5D:
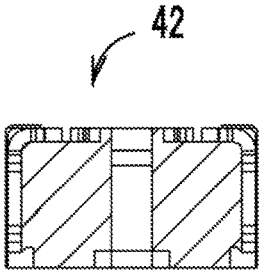
FIG. 5(D) is a section view of the housing at a second fixture.

FIG. 5(A) is a perspective view of a housing viewing from a fitting direction, and FIG. 5(B) is a perspective view of the housing viewing from an opposite side of the fitting direction, and FIG. 5(C) is a section view of the housing at a portion fitting a receptacle contact, and FIG. 5(D) is a section view of the housing at a second fixture.

Figure 6A:
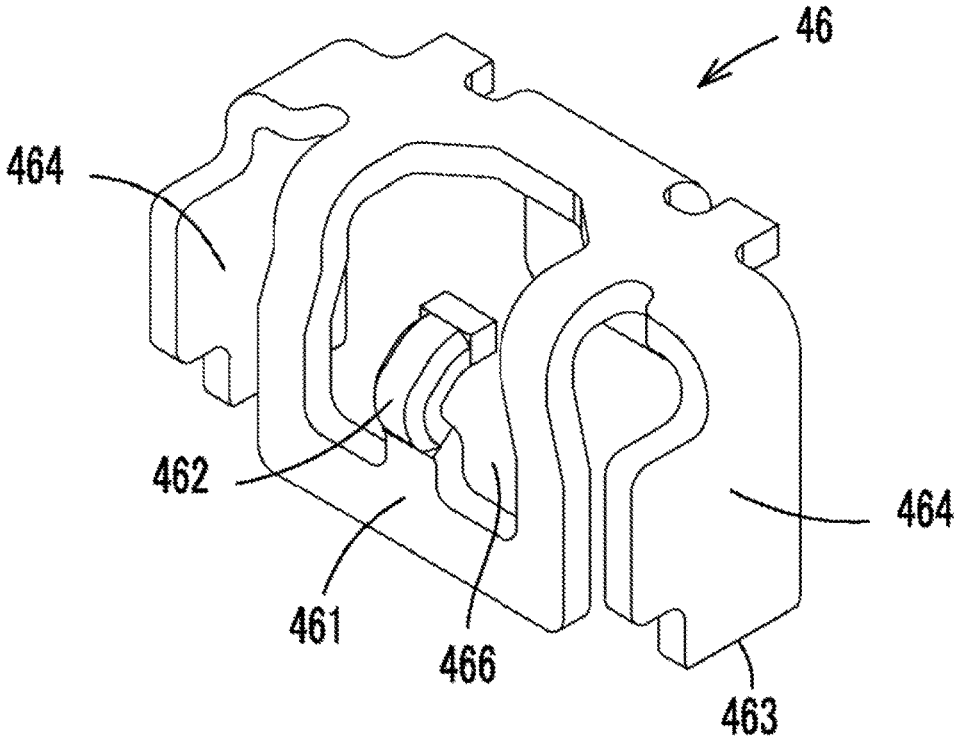
FIG. 6(A) is a perspective view of a second fixture viewing from a fitting portion, and FIG. 6 (B) is a perspective view of the second fixture viewing from an opposite side of the fitting direction.
Figure 6B:
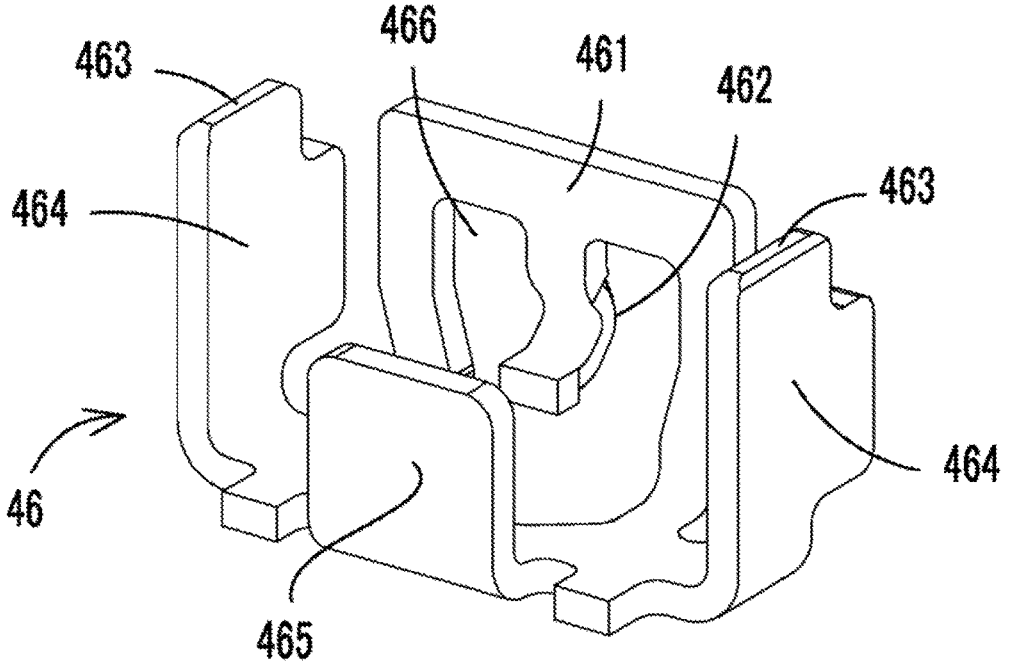

FIG. 6(A) is a perspective view of a second fixture viewing from a fitting portion, and FIG. 6(B) is a perspective view of the second fixture viewing from an opposite side of the fitting direction.

Figure 7A:
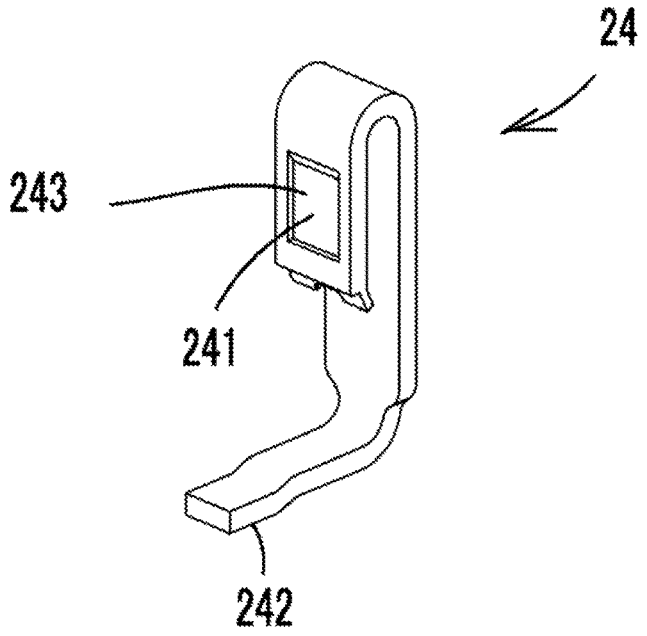
FIG. 7(A) is a perspective view of a plug contact viewing from a side of a contact portion.
Figure 7B:
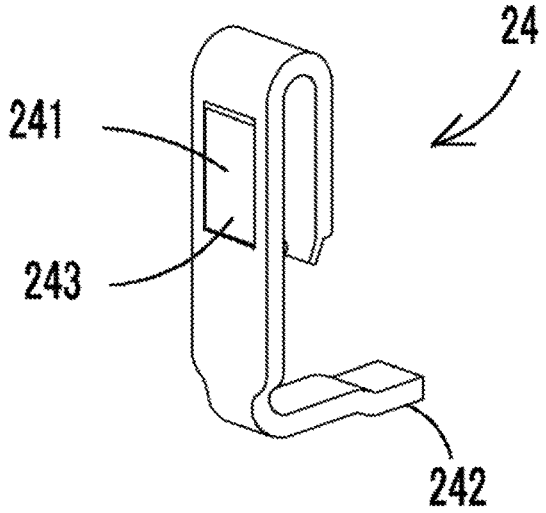
FIG. 7(B) is a perspective view of the plug contact viewing from an opposite side of the contact portion.

FIG. 7(A) is a perspective view of a plug contact viewing from a side of a contact portion, and FIG. 7(B) is a perspective view of the plug contact viewing from an opposite side of the contact portion.

Figure 8A:
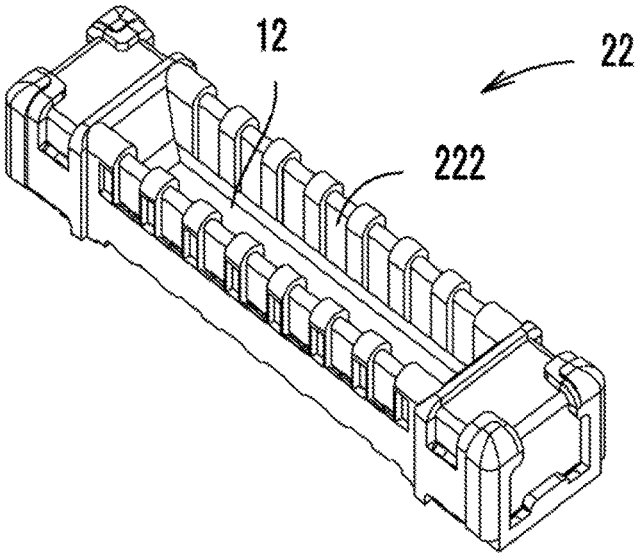
FIG. 8(A) is a perspective view of a block viewing from a fitting direction.
Figure 8B:
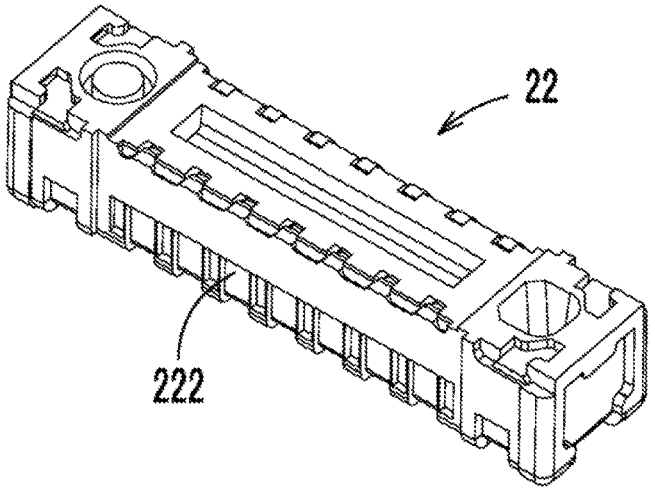
FIG. 8(B) is a perspective view of the block viewing from an opposite side of the fitting direction.
Figure 8C:
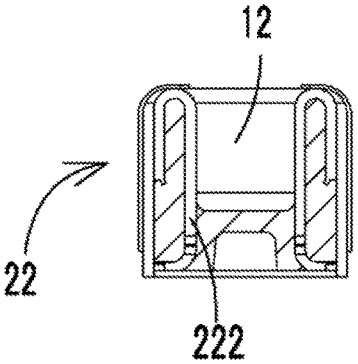
FIG. 8(C) is a section view of the block at a portion fitting a plug contact.
Figure 8D:
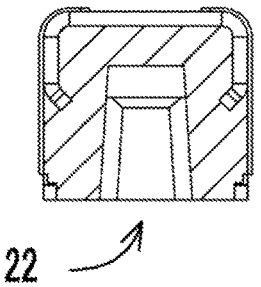
FIG. 8(D) is a section view of the block at a first fixture.

FIG. 8(A) is a perspective view of a block viewing from a fitting direction, and FIG. 8(B) is a perspective view of the block viewing from an opposite side of the fitting direction, and FIG. 8(C) is a section view of the block at a portion fitting a plug contact, and FIG. 8(D) is a section view of the block at a first fixture.

Figure 9A:
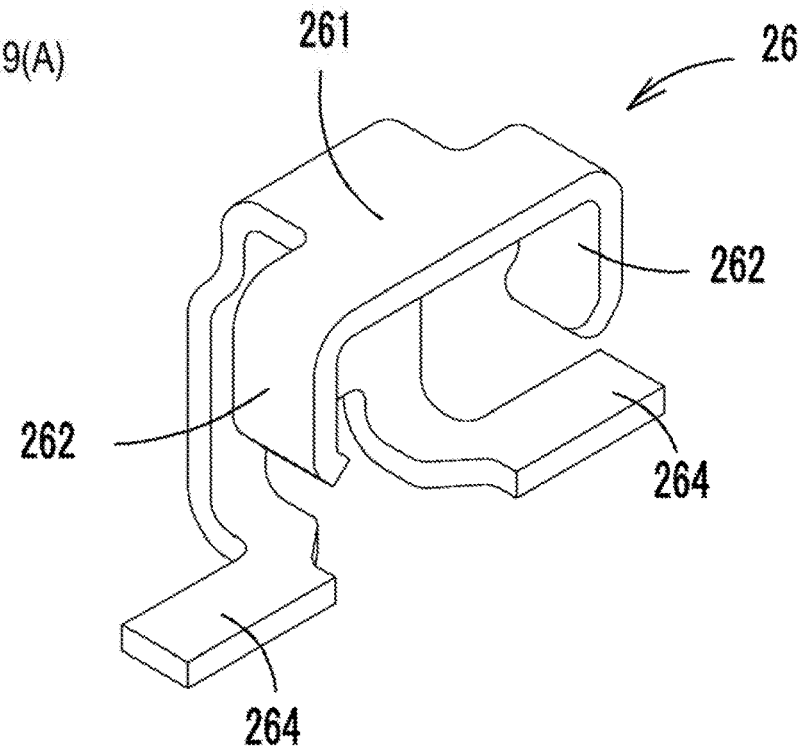
FIG. 9(A) is a perspective view of a first fixture viewing from a fitting direction.
Figure 9B:
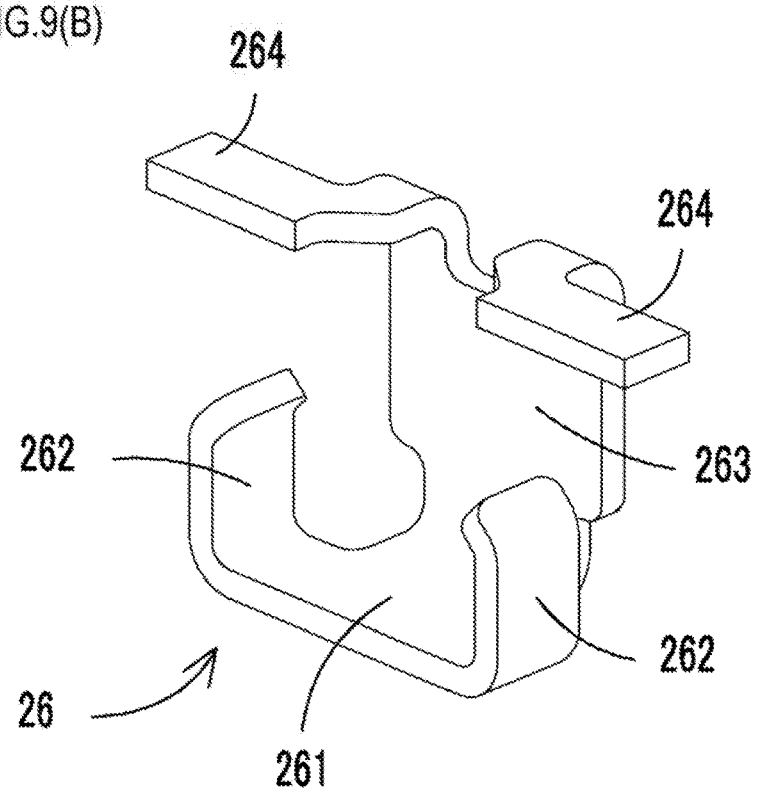
FIG. 9(B) is a perspective view of the first fixture viewing from an opposite side of the fitting direction.

FIG. 9(A) is a perspective view of a first fixture viewing from a fitting direction, and FIG. 9 (B) is a perspective view of the first fixture viewing from an opposite side of the fitting direction.

In this embodiment, the electric connector 10 comprises the plug connector 20 and the receptacle connector 40, in which the plug connector 20 is provided at least with a plurality of plug contacts 24 and a block 22, and the receptacle connector 40 is provided at least with a plurality of receptacle contacts 44 and a housing 42. Furthermore, the plug connector 20 is provided with a first fixture 26, and the receptacle connector 40 is provided with a second fixture 46.

Prior to the explanation of the electric connector 10 according to the invention will be described a substrate mounting the connectors 20 and 40. As the substrate includes a hard substrate, FPC (flexible printed circuit) and the like. Here, the hard substrate will be described as an example. The substrate is provided with lands at least connecting to the connection portions 242, 443 of the contacts 24 and 44 and a pattern connecting from the lands to a circuit.

The receptacle connector 40 will be described below. At first, the receptacle contact 44 will be explained. The receptacle contact 44 is made from a metal and manufactured by a well-known press working. As a material of the receptacle contact 44 may be mentioned beryllium copper, phosphor bronze, Corson alloy and the like because it is required to have a spring property and a conductivity. The receptacle contact 44 comprises a contact portion 441 contacting with the plug contact 24 as the other contact, a connection portion 443 connecting to the substrate, and an elastic portion 444 of at least one curved form between the contact portion 441 and the connection portion 443 in the arranging order of the contact portion 441, the elastic portion 444 and the connection portion 443, and further a fixing portion 442 for holding in the housing 42 is provided in a part of the elastic portion 444 at the side of the connection portion 443. Also, a first chamfering portion 446 is formed in the contact portion 441, while a second chamfering portion 447 is formed in a part of the elastic portion 444 at the side of the fixing portion 442. An inclination portion 445 is formed between the elastic portion 444 and the contact portion 441, while an enlarged engaging portion 45 communicating with the inclination portion 445 is formed at the side of the contact portion 441.

The contact portion 441 is a portion contacting with the plug contact 24 and has a surface-contacting form in consideration of the connection stability, and a first chamfering portion 446 is formed in the contact portion 441 so as to easily enter the concave portion 243 of the plug contact 24. The form and size of the contact portion 441 and the first chamfering portion 446 are properly designed in consideration of the function, connection stability, workability and the like.

The connection portion 443 is a portion mounted on the substrate and is a surface mounting type (SMT) in this example. As the connection portion 443 may be a dip type or a place-in type as long as it can be mounted onto the substrate. It is designed in consideration of a substrate occupying area, a mounting density and the like.

The elastic portion 444 is a portion ensuring an elastic length and an elastic force to provide a stable connection to the plug contact 24. Also, a second chamfering portion 447 is formed in the elastic portion 444 so as to easily enter the concave portion 243 of the plug contact 24. The form and size of the elastic portion 444 and the second chamfering portion 447 are properly designed in consideration of the function, connection stability, workability and the like. That is, the elastic portion 444 is used as a second contact portion and the plug contact 24 is interleaved by the contact portion 441 and the elastic portion 444 so as to provide a stable connection.

The inclination portion 445 disposed between the contact portion 441 and the elastic portion 444 is a portion having substantially the same form as the inclination portion 422 in the insertion hole 421 of the housing 42 for adjusting backup so as to provide a stable connection. The form and size of the inclination portion 445 are properly designed along the inclination portion 422 of the housing 42 and in consideration of the function, connection stability, workability and the like.

The fixing portion 442 is a portion fixing to the housing 42, which is fixed to the housing 42 by press fitting, hooking (lance), welding or the like. In this example, it is fixed by press fitting. The form and size of the fixing portion 442 are properly designed in consideration of the holding force, strength, workability and the like.

The enlarged engaging portion 45 is a portion preventing from uplifting by engaging (hooking) with the enlarged locking portion 43 of the housing 42 in the detachment of the plug contact 24 and from buckling in the re-insertion of the plug contact 24. The form and size of the enlarged engaging portion 45 may be anything as long as the function is satisfied and are properly designed in consideration of the function, small-sizing of connector, workability and the like.

Next, the housing 42 will be described below. The housing 42 is made from an electrical insulation plastic and manufactured by a well-known injection molding. A material thereof is properly selected in consideration of dimensional stability, workability, cost and the like and may generally include polybutylene terephthalate (PBT), polyamide (66PA, 46PA), liquid crystal polymer (LCP), polycarbonate (PC) and a synthetic material thereof.

The housing 42 has a fitting portion 14 entering the first fitting port 12 of the plug connector 20 and a second fitting port 16 for inserting the plug connector 20. The form and size of the fitting portion 14 and second fitting port 16 are properly designed in consideration of the small-sizing of connector, connection stability, strength, workability and the like along the form and size of the other party as long as it may be inserted into the first fitting port 12 and insert the plug connector 20.

The required number of the receptacle contacts 44 and the second fixtures 46 are mounted on the housing 42. Accordingly, the housing 42 is provided with the required number of insertion holes 421 for mounting the receptacle contacts 44. Since the second fixtures 46 are held by integral molding, insertion hole therefor is unnecessary (since the drawing is depicted at a state of omitting the second fixtures, depression is shown in the figure). The form and size of the insertion hole 421 may be anything as long as the receptacle contact 44 can be inserted therein and are properly designed in consideration of the connection stability, holding force, strength, workability and the like.

In the insertion hole 421 of the housing 42 is formed an enlarged locking portion 43 engaging (hooking) with the enlarged engaging portion 45 at a position corresponding to the enlarged engaging portion 45. The enlarged locking portion 43 is a portion preventing uplifting by engaging (hooking) with the enlarged engaging portion 45 of the receptacle contact 44 in the detachment of the plug contact 24 and from buckling in the re-insertion of the plug contact 24. The form and size of the enlarged locking portion 43 may be anything as long as the function is satisfied and are properly designed in consideration of the function, small-sizing of connector, workability and the like.

The second fixture 46 will be explained below. The second fixture 46 is made from a metal and manufactured by a well-known press forming. As a material of the second fixture 46 may be included beryllium copper, phosphor bronze and the like because it is required to have a spring property and a formability.

The second fixture 46 comprises a front wall 461 located at the side of the second fitting port 16, a contact portion 462 formed by arranging a space 466 in the front wall 461 and disposed so as to protrude in the second fitting port 16, two side walls 464 communicating with the front wall 461 in a widthwise direction and a rear wall 465 arranged opposite to the front wall 461. In the tip of each of the side walls 464 is provided a connection portion 463 connecting to the substrate. In this example, the connection portion 463 is a surface mounting type (SMT) in consideration of a mounting density and the like, but may be a dip type.

The second fixture 46 is held by integral molding to the housing 42. It is a portion integrally molded to the housing 42 other than the contact portion 462 and the connection portion 463 and reinforcing the strength. The form and size other than the contact portion 462 and the connection portion 463 may be anything as long as the strength is reinforced and are properly designed in consideration of the strength, workability and the like.

The contact portion 462 is a portion contacting with the first fixture 26, and a space 466 is formed therein for ensuring a sufficient elasticity.

A constructional component of the plug connector 20 will be explained with reference to the drawings. At first, the plug contact 24 will be described. The plug contact 24 is made from a metal and manufactured by a well-known press forming. Since the plug contact is required to have a spring property and a conductivity, beryllium copper, phosphor bronze, Corson alloy and so on may be mentioned as a material thereof.

In this example, the plug contact 24 has approximately a L-shaped form as shown in FIG. 7. The plug contact 24 comprises a contact portion 241 at least contacting with the receptacle contact 44 as the other contact and a connection portion 242 connecting to the substrate 80. In this example, the plug contact 24 is held in the block 22 by integral molding.

In the contact portion 241 of the plug contact 24 is formed a concave portion 243 for inserting the receptacle contact 44. A click feeling and a stable connection can be obtained without position shifting by inserting the the first chamfering portion 446 of the receptacle contact 44 into the concave portion 243. The form and size of the concave portion 243 may be anything as long as the receptacle contact 44 can be inserted therein and are properly designed so as to obtain a stable connection along the form and size of the receptacle contact 44.

The connection portion 242 is a portion mounted on the substrate and is a surface mounting type (SMT) in this example. It may be a dip type as long as it can be mounted onto the substrate.

The plug contact 24 is desirable to be provided with another concave portion 243 at a side opposite to the contact portion 241 (rear face). In the concave portion 243 is inserted the second chamfering portion 447 of the receptacle 44 and the plug contact 24 is held between the first chamfering portion 446 and the second chamfering portion 447 of the receptacle contact 44 to more provide a click feeling and a stable connection without position shifting. The form and size of the concave portion 243 may be anything as long as the receptacle contact 44 can be inserted therein and are properly designed so as to provide a stable connection along the form and size of the receptacle contact 44.

The block 22 will be described below. The block 22 is made from an electrical insulation plastic and manufactured by a well-known injection molding. A material thereof is properly selected in consideration of dimensional stability, workability, cost and the like but may generally include polybutylene terephthalate (PBT), polyamide (66PA, 46PA), liquid crystal polymer (LCP), polycarbonate (PC) and a synthetic material thereof. To the block are attached the plug contact 24 and first fixture 26.

In the block 22 is provided a first fitting port 12 for inserting the fitting portion 14 of the receptacle connector 40 in the fitting of the receptacle connector 40. The first fitting port 12 is anything as long as the fitting port 40 can be inserted therein, and the form and size thereof are properly designed along the fitting portion 14 in consideration of the strength, workability, connection stability and the like.

To the block 22 are fixed the plug contact 24 and the first fixture 26 by integral molding. Therefore, holes for inserting the plug contact 24 and first fixture 26 are unnecessary in the block 22 (the drawing is depicted at a state of omitting the plug contact and first fixture, so that depression is shown in the figure). The first fixture 26 is fixed to both sides of the block 22 in a longitudinal direction by integral molding. It is fixed by integral molding in this example, but the insertion and holding method of the plug contact 24 and first fixture 26 is properly designed in consideration of holding force, strength, workability and the like.

Finally, the first fixture 26 will be described. The first fixture 26 is made from a metal and manufactured by a well-known press forming. Since the first fixture 26 is required to have a spring property and a formability, beryllium copper, phosphor bronze and so on may be mentioned as a material thereof.

The first fixture 26 comprises at least a main body 261, a contact wall 263 contacted with a second fixture 46 and communicated from the main body 261, fixing pieces 262 communicating in the widthwise direction and connection portions 264 communicating with the contact wall 263. The first fixture 26 is fixed to the block 22 by integral molding. The connection portion 264 is a surface mounting type (SMT) in consideration of a mounting density and the like, but may be a dip type.

The contact wall 263 is a portion contacting with the contact portion 462 of the second fixture 46, and the form, size and thickness thereof are properly designed in consideration of a contact stability.

The invention is utilized to an electric connector used in mobile terminals, audio instruments, communication equipment, electric instruments and electronics and is particularly concerned with a structure of stable fitting capable of maintaining strength and connection stability and preventing uplifting in detachment and buckling in insertion while attaining a small-sizing (particularly in a widthwise direction) and a low profile.

10 electric connector
12 first fitting port
14 fitting portion
16 second fitting port
20 plug connector
22 block
222 insertion groove
24 plug contact
241 contact portion
242 connection portion
243 concave portion
26 first fixture
261 main body
262 fixing piece
263 contact wall
264 connection portion
40 receptacle connector
42 housing
421 insertion hole
422 inclination portion
43 enlarged locking portion
44 receptacle contact
441 contact portion
442 fixing portion
443 connection portion
444 elastic portion
445 inclination portion
446 first chamfering portion
447 second chamfering portion
45 enlarged engaging portion
46 second fixture
461 front wall
462 contact portion
463 connection portion
464 side wall
465 rear wall
466 space

What is claimed is:

1. An electric connector comprising a plug connector and a receptacle connector detachably fitting to each other, said plug connector comprising a plug contact having a contact portion contacting with a receptacle contact and a connection portion mounted onto a substrate and a block arranging and holding the plug contact and having a first fitting port for inserting a fitting portion of the receptacle connector, and said receptacle connector comprising a receptacle contact having a contact portion contacting with the plug contact and a connection portion mounted onto a substrate and a housing arranging and holding the receptacle contact and having a fitting portion entering the first fitting port of the plug connector and a second fitting port for inserting the plug connector, wherein the plug contact is held with the block by integral molding and is provided with a concave portion for inserting the receptacle contact;

the receptacle contact is provided between the contact portion and the connection portion with an elastic portion of at least one curved form in the order of the contact portion, elastic portion and connection portion, and a fixing portion for holding in the housing is provided in a part of the elastic portion at the side of the connection portion, and an inclination portion is formed between the elastic portion and the contact portion and further an enlarged engaging portion communicating with the inclination portion is formed at the side of the contact portion;

the housing is provided with an insertion hole for inserting the receptacle contact, and the insertion hole is formed continuously to the curved inclination portion, and an enlarged locking portion is formed in a position corresponding to the enlarged engaging portion;

the plug contact is interleaved between the contact portion and the elastic portion of the receptacle contact to provide a stable connection and the enlarged engaging portion is locked by the enlarged locking portion in detachment to prevent uplifting and suppress buckling in re-insertion.

2. An electric connector according to claim 1, wherein a first chamfering portion is formed in the contact portion of the receptacle contact and a second chamfering portion is formed in a part of the elastic portion at the side of the fixing portion, and the first chamfering portion of the receptacle contact is engaged with the concave portion of the plug contact to provide click feeling and positioning and contacting.

3. An electric connector according to claim 1, wherein a first fixture and a second fixture contacting with each other in the fitting of the connectors are provided at either end of the connector in a longitudinal direction.

4. An electric connector according to claim 3, wherein the first fixture comprises a main body, a contact wall communicating from the main body and contacting with the second fixture, fixing pieces communicating in a widthwise direction and a connection portion communicating with the contact wall, and the second fixture comprises a front wall located at the side of the second fitting port, a contact portion formed by disposing a space in the front wall and arranged so as to protrude in the second fitting port, two side walls communicating with the front wall in the widthwise direction, and a back wall arranged opposite to the front wall.

* * * * *